US009206625B2

(12) United States Patent
Lai

(10) Patent No.: US 9,206,625 B2
(45) Date of Patent: Dec. 8, 2015

(54) PADLOCK WITH FULLY INTEGRATED DUAL UNLOCKING SYSTEM

(71) Applicant: The Sun Lock Company Ltd., Tuen Mun, N.T. (HK)

(72) Inventor: Karl Lai, Tai Po (HK)

(73) Assignee: THE SUN LOCK COMPANY LIMITED, Tuen Mun, NT (HK)

( * ) Notice: Subject to any disclaimer, the term of this patent is extended or adjusted under 35 U.S.C. 154(b) by 0 days.

(21) Appl. No.: 14/215,638

(22) Filed: Mar. 17, 2014

(65) Prior Publication Data

US 2014/0373579 A1 Dec. 25, 2014

Related U.S. Application Data

(60) Provisional application No. 61/839,023, filed on Jun. 25, 2013.

(51) Int. Cl.

| | |
|---|---|
| ***E05B 67/06*** | (2006.01) |
| ***E05B 35/10*** | (2006.01) |
| ***E05B 37/00*** | (2006.01) |
| ***E05B 37/02*** | (2006.01) |

(52) U.S. Cl.

CPC ..... *E05B 67/06* (2013.01); *E05B 35/105* (2013.01); *E05B 37/0034* (2013.01); *E05B 37/025* (2013.01); *Y10T 70/415* (2015.04)

(58) Field of Classification Search

CPC . E05B 37/0034; E05B 37/025; E05B 35/105; E05B 35/00; E05B 67/24; E05B 67/06

USPC ..... 70/20, 21, 22, 24, 25, 31, 35, 38 R, 38 A, 70/38 B, 38 C, 284, 285

See application file for complete search history.

(56) References Cited

U.S. PATENT DOCUMENTS

| | | | | |
|---|---|---|---|---|
| 6,539,761 | B2 * | 4/2003 | Yang | 70/284 |
| 6,860,125 | B1 * | 3/2005 | Yu | 70/25 |
| 7,047,773 | B1 | 5/2006 | Lin | |
| 7,121,123 | B2 * | 10/2006 | Yu | 70/21 |
| 7,340,927 | B2 * | 3/2008 | Yu et al. | 70/21 |
| 7,552,607 | B2 * | 6/2009 | Yang | 70/21 |
| 7,628,045 | B2 * | 12/2009 | Yu | 70/21 |
| 7,779,657 | B2 * | 8/2010 | Yu | 70/21 |

(Continued)

FOREIGN PATENT DOCUMENTS

| | | | |
|---|---|---|---|
| GB | 2493266 A | | 1/2013 |
| GB | 2519128 A | * | 4/2015 |

*Primary Examiner* — Lloyd Gall

*Assistant Examiner* — Amanda L Miller

(74) *Attorney, Agent, or Firm* — Ware, Fressola, Maguire & Barber LLP

(57) ABSTRACT

A padlock with a dual unlocking system, namely, a key mechanism and a combination mechanism. The key mechanism has a bolt or latch passing through a pole/pole cover secured around a portion of a shackle, the bolt in contact with the shackle so as to prevent movement of the shackle relative to the key mechanism when the key mechanism is in a locked state. The bolt/latch is able to move relative to the shackle to allow the shackle to move relative to the housing and pole so as to release the toe of the shackle from the housing when the key mechanism is in an unlocked state. The combination mechanism allows clutches to move relative to the housing into a lock open position when dials are in an opening combination that allows the pole to move relative to the housing so as to release the toe.

18 Claims, 12 Drawing Sheets

(56) References Cited

U.S. PATENT DOCUMENTS

| | | | | |
|---|---|---|---|---|
| 7,832,238 | B2 * | 11/2010 | Misner et al. | 70/21 |
| 2003/0000264 | A1 * | 1/2003 | Yang | 70/25 |
| 2005/0044901 | A1 * | 3/2005 | Yu | 70/25 |
| 2006/0156769 | A1 * | 7/2006 | Yu | 70/21 |
| 2006/0225469 | A1 * | 10/2006 | Yu | 70/21 |
| 2006/0266084 | A1 * | 11/2006 | Kuo et al. | 70/21 |
| 2008/0011025 | A1 * | 1/2008 | Lin | 70/21 |
| 2008/0098774 | A1 * | 5/2008 | Huang | 70/21 |
| 2008/0307839 | A1 | 12/2008 | Yu | |
| 2008/0314093 | A1 * | 12/2008 | Nave | 70/21 |
| 2009/0113947 | A1 * | 5/2009 | Lai et al. | 70/21 |

* cited by examiner

PADLOCK WITH FULLY INTEGRATED DUAL UNLOCKING SYSTEM

CROSS REFERENCE TO RELATED APPLICATION

This application claims priority under 35 USC §119 to U.S. Provisional Patent Application No. 61/839,023 filed on Jun. 25, 2013, whose entire contents are hereby incorporated by reference.

TECHNICAL FIELD

The present invention relates to padlocks, in particular a padlock with a dual locking mechanism.

BACKGROUND OF THE INVENTION

Numerous padlock constructions have been developed and are widely employed to prevent unauthorized persons from gaining access to any particular item or area which has been closed and locked. Although many locks are constructed to be opened by a key, numerous combination lock constructions have been developed which can be opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing (unlocking) the lock. Typically, the combination lock has one mode, position, or state in which the user is able to set or reset the desired combination sequence (opening combination) of the dials.

It has been found that many of these prior art padlocks are employed by individuals to secure their luggage or suitcases during travel. In this regard, in airplane travel, new regulations and requirements allow customs officers and transit security personnel (hereafter collectively security personnel) to physically break any padlock in order to gain access to luggage which is deemed suspicious. Under these new security regulations, all luggage must be scanned or inspected to prevent the transportation of potentially dangerous items or products and other items deemed to be undesirable. In those instances when luggage is scanned and further visual inspection is required, the inspectors have the authority to open the luggage for visual inspection, including physically breaking any padlock which may be on the luggage.

With these new regulations presently implemented, all prior art systems which are incapable of being opened by inspectors and/or security personnel are subject to being physically broken, in order to gain access to any luggage which needs to be visually inspected. As a result, consumers (travelers) are faced with the possibility that any like system employed to protect the contents of the suitcase can be physically removed by security personnel, leaving the luggage completely unprotected during the remainder of the trip.

In order to eliminate the possibility of having a padlock completely broken by security personnel, newer prior art padlocks have been constructed with two separate and independent locking systems formed in a single padlock, with both locking systems independently enabling a single shackle to be released and/or lockingly engaged. In this way, by employing either a key activation zone or a combination activation zone, the padlock can be opened. Furthermore, padlocks of this general construction employ key controlled constructions which are opened using master keys which are in the possession of security personnel. In this way, security personnel are able to open these padlocks for inspecting the contents of the luggage, and then re-lock the padlock in place after the inspection has been completed.

SUMMARY OF THE INVENTION

A padlock according to an embodiment of the present invention comprises a shackle having a short leg portion, a long leg portion, and a toe at an end of the short leg portion and a heel at the end of the long leg portion, a housing having holes formed therein dimensioned to receive the toe and the heel of the shackle, the heel of the shackle positioned inside the housing, the shackle movable between an unlocked position with the toe positioned away from the housing to a locked position with the toe inside the housing, a pole and a pole cover secured around a portion of the long leg of the shackle, a key mechanism having a locked state and an unlocked state, the key mechanism including a tumbler for receipt of a key, and a shackle contacting member, the shackle contacting member passing through a slot formed in the pole/pole cover, the shackle contacting member in contact with the shackle so as to prevent movement of the shackle relative to the key mechanism when the key mechanism is in the locked state, the shackle contacting member able to move in the housing relative to the shackle so as to allow the shackle to move relative to both the housing and pole/pole cover so as to release the toe from the housing when the key mechanism is in the unlocked state, the pole connected to a combination mechanism, the combination mechanism having a clutch-end engaged with slopes formed in the pole when the combination mechanism is in a locked state, the combination mechanism including a spindle placed in proximity to dials and an overall clutch comprising a plurality of clutches such that when the dials are in an opening combination, extended protrusions of the spindle align with opening gaps of the clutches that allows the clutches to move relative to the housing into a lock open position that allows the pole/pole cover to move relative to the housing so as to release the toe of the shackle from the housing when the shackle is pulled away from the housing.

Another embodiment of the present invention is the padlock as described above, wherein the clutch-end has two slopes, a lower slope to control movement of the pole so as to release the toe of the shackle while extended-fins of the clutches remain engaged with the teeth of the dial and opening gaps formed in the clutches are engaged with the extended protrusions of the spindle so as to prevent the clutches from having rotational movement and thereby restricts rotation and movement of the dials, and an upper slope to control a reset state of the combination mechanism such that as the pole pushes the clutch-end, it moves the clutches further relative to the housing such that the extended-fin of the clutches disengages with the teeth of the dials, allowing the opening combination of the combination mechanism to be reset.

A further embodiment of the present invention is the padlock as described above, wherein a ring is positioned around a portion of the shackle, wherein the shackle includes an extended-projection that passes through the ring, wherein when the toe of the shackle is released from the housing, the shackle is rotatable relative to the housing to allow the extended-projection to be inserted into a reset slot formed in the housing thereby allowing the pole to be moved by pushing the shackle toward the housing so as to cause the combination mechanism to be moved to a reset state that allows the dials to be turned to reset the opening combination.

A still further embodiment of the present invention is the padlock as described above, wherein the spindle includes a block placed in a slot formed in the combination mechanism so as to prevent movement of the spindle, wherein when the dials are in the opening combination, the extended protrusion of the spindle is aligned with an opening slot of the overall clutch and the overall clutch is allowed to move relative to the housing when the pole is moved relative to the housing by pulling the shackle away from the housing.

Another embodiment of the present invention is the padlock as described above, wherein the spindle includes a block placed in a slot formed in the combination mechanism so as to prevent movement of the spindle, wherein when the dials are in the opening combination, the extended protrusion of the spindle is aligned with an opening slot of the overall clutch and the overall clutch is allowed to move relative to the housing when the pole is moved relative to the housing by pulling the shackle away from the housing.

A further embodiment of the present invention is the padlock as described above, wherein the key mechanism includes a cylinder, a blocking plate and a cam, the blocking plate in contact with the shackle contacting member, the blocking plate with an extended ring engaged with a slope-slot formed in the cam, wherein the cam is connected to the cylinder by an extended protrusion of the cylinder, wherein movement of the cam allows the blocking plate to move relative to the housing and thereby allows the shackle contacting member to move away from the shackle to unlock the shackle when the key mechanism is in the unlocked state.

A further embodiment of the present invention is the padlock as described above, wherein the shackle contacting member remains in in contact with the shackle when the dials are in the opening combination and when the combination mechanism is in a reset state, and wherein the shackle contacting member is allowed to move relative to the housing when the key mechanism is in the unlocked state.

A still further embodiment of the present invention is the padlock as described above, wherein the shackle contacting member is a bolt, wherein the shackle includes a sloped section formed on the long leg of the shackle, wherein the bolt is in contact with the sloped section of the shackle when the key mechanism is in the locked state and wherein the bolt is able to move in the housing relative to the sloped section to allow the shackle to move relative to the housing and pole/pole cover so as to release the toe from the housing when the key mechanism is in the unlocked state.

Another embodiment of the present invention is the padlock as described above, wherein the bolt remains in the sloped section of the shackle when the dials are in the opening combination and when the combination mechanism is in a reset state, and wherein the bolt is allowed to move relative to the housing when the key mechanism is in the unlocked state.

Another embodiment of the present invention is the padlock as described above, wherein the bolt, shackle, pole, and pole cover are assembled together to form one piece, wherein the bolt engages with the sloped section of the shackle so that pulling the shackle relative to the housing is transferred to the pole.

A further embodiment of the present invention is the padlock as described above, wherein the sloped section of the shackle is placed inside the pole/pole cover, wherein the sloped section always engages the bolt when the key mechanism is in the locked state, or when the dials are in the opening combination, or when the combination mechanism is in the reset state; and wherein the bolt disengages from the sloped section of the shackle when the key mechanism is in the unlocked state.

A still further embodiment of the present invention is the padlock as described above, wherein when the dials of the combination mechanism are in the opening combination, the bolt has no movement relative to the sloped section of the shackle.

Another embodiment of the present invention is the padlock as described above, wherein the clutch-end has two slopes, a lower slope to control movement of the pole so as to release the toe of the shackle while extended-fins of the clutches remain engaged with the teeth of the dial and opening gaps formed in the clutches are engaged with the extended protrusions of the spindle so as to prevent the clutches from having rotational movement and thereby restricts rotation and movement of the dials, and an upper slope to control a reset state of the combination mechanism such that as the pole pushes the clutch-end, it moves the clutches further relative to the housing such that the extended-fin of the clutches disengages with the teeth of the dials, allowing the opening combination of the combination mechanism to be reset.

Another embodiment of the present invention is the padlock as described above, wherein a ring is positioned around a portion of the shackle, wherein the shackle includes an extended-projection that passes through the ring, wherein when the toe of the shackle is released from the housing, the shackle is rotatable relative to the housing to allow the extended-projection to be inserted into a reset slot formed in the housing thereby allowing the pole to be moved by pushing the shackle toward the housing so as to cause the combination mechanism to be moved to a reset state that allows the dials to be turned to reset the opening combination.

A further embodiment of the present invention is the padlock as described above, wherein when the dials of the combination mechanism are in the opening combination, the shackle contacting member has no movement relative to the shackle.

A further embodiment of the present invention is the padlock as described above, wherein the shackle contacting member is a latch having a fork, wherein the shackle long leg includes a shackle section dimensioned to contact the fork of the latch when the key mechanism is in the locked state and wherein the fork of the latch is moved away from said shackle section when the key mechanism is in the unlocked state.

A still further embodiment of the present invention is the padlock as described above, wherein the latch includes a spring to push a blocking plate of the key mechanism when the key mechanism is in the unlocked state and wherein the blocking plate pushes the latch to cause the fork area of the latch toward the shackle when the key mechanism is in the locked state.

Another embodiment of the present invention is the padlock as described above, wherein the clutch-end has two slopes, a lower slope to control movement of the pole so as to release the toe of the shackle while extended-fins of the clutches remain engaged with the teeth of the dial and opening gaps formed in the clutches are engaged with the extended protrusions of the spindle so as to prevent the clutches from having rotational movement and thereby restricts rotation and movement of the dials, and an upper slope to control a reset state of the combination mechanism such that as the pole pushes the clutch-end, it moves the clutches further relative to the housing such that the extended-fin of the clutches disengages with the teeth of the dials, allowing the opening combination of the combination mechanism to be reset.

Another embodiment of the present invention is the padlock as described above, wherein a ring is positioned around a portion of the shackle, wherein the shackle includes an extended-projection that passes through the ring, wherein when the toe of the shackle is released from the housing, the shackle is rotatable relative to the housing to allow the extended-projection to be inserted into a reset slot formed in the housing thereby allowing the pole to be moved by pushing the shackle toward the housing so as to cause the combination mechanism to be moved to a reset state that allows the dials to be turned to reset the opening combination.

BRIEF DESCRIPTION OF THE DRAWINGS

For a fuller understanding of the nature and objects of the present invention, references is made to the following detailed description taken in conjunction with the following drawings in which.

DETAILED DESCRIPTION

Overview (FIGS. 1A-23)

Figure 1A:
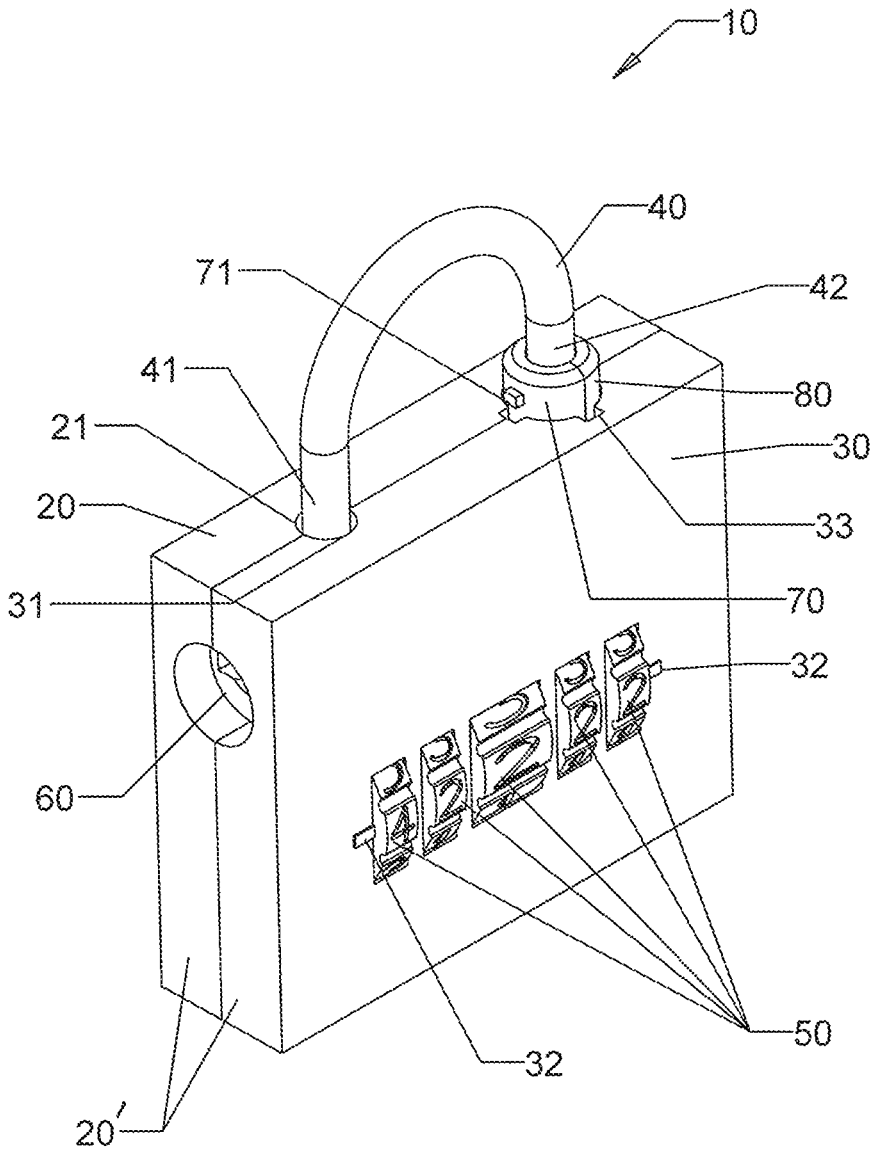
FIG. 1A is a front perspective view of an exemplary embodiment of a padlock according to the present invention.
Figure 1B:
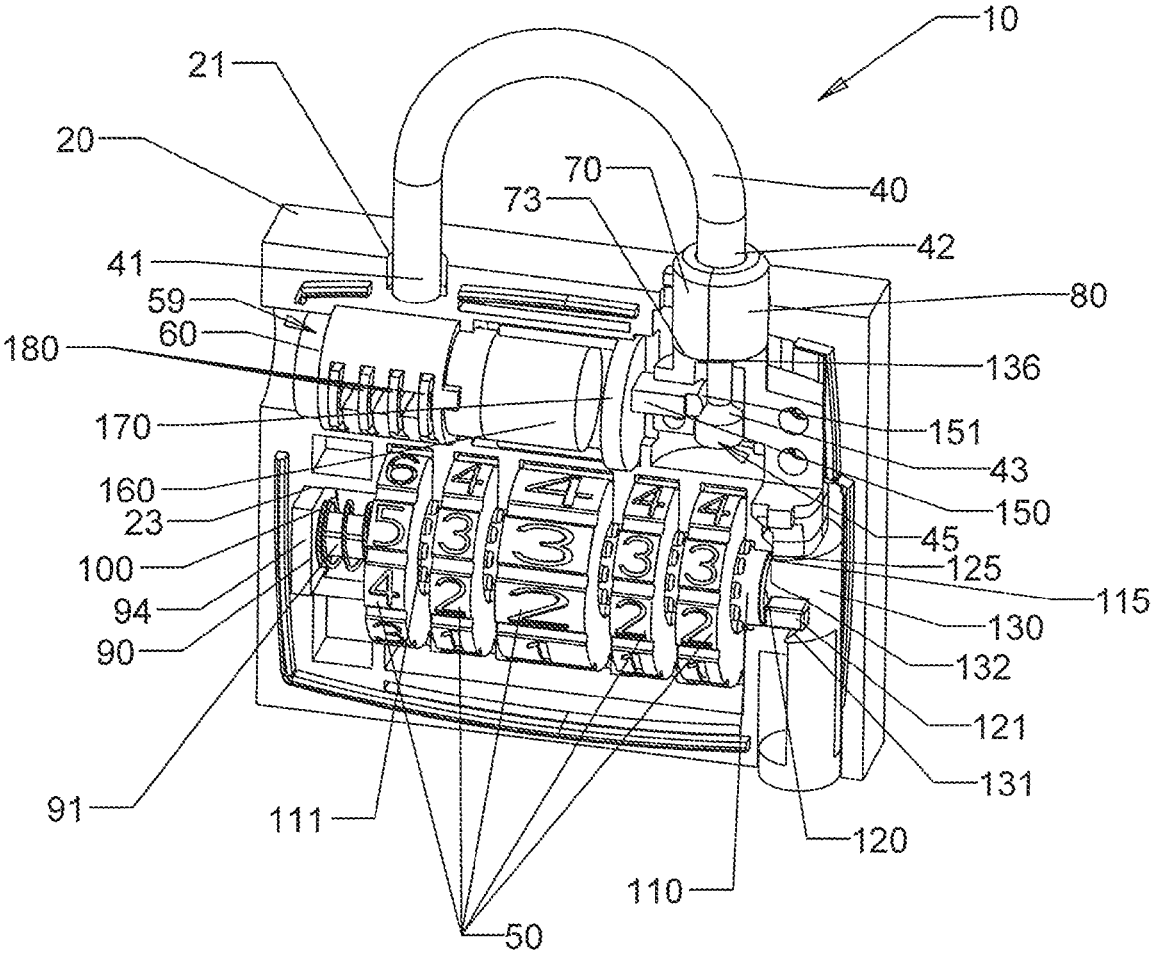
FIG. 1B is a front perspective view of the padlock shown in FIG. 1A with a front portion of the lock body/housing removed.
Figure 20:
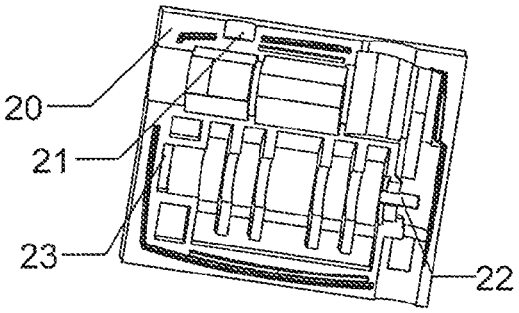
FIG. 20 is a perspective view of the interior of the rear portion of the lock body/housing of the padlock.
Figure 21:
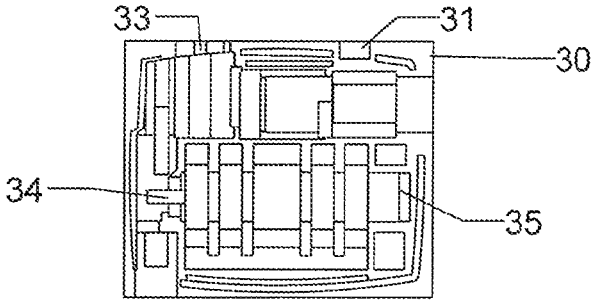
FIG. 21 is an interior view of the front portion of the lock body/housing.
Figure 22A:
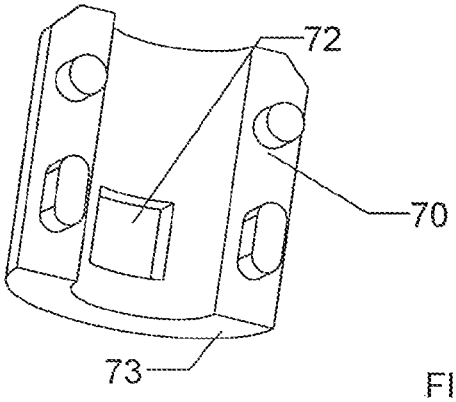
FIG. 22A is a perspective view of a portion of a ring forming part of the padlock.
Figure 22B:
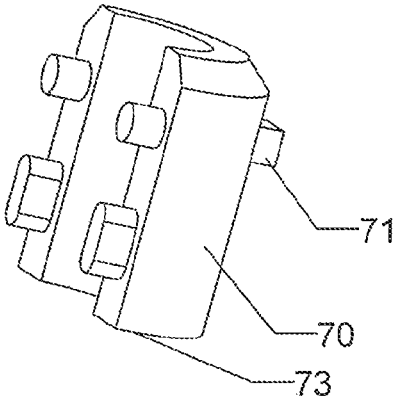
FIG. 22B is a side perspective view of the ring portion shown in FIG. 22A.
Figure 23:
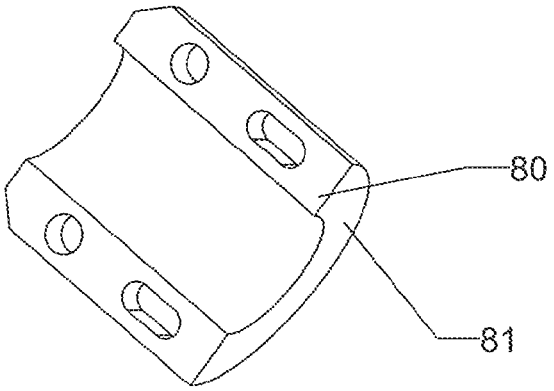
FIG. 23 is a perspective view of a mating portion to the ring portion shown in FIGS. 22A-22B.

A padlock 10 according to an embodiment of the present invention with dual locking mechanism is enclosed in a locking body/housing 20' having a rear portion 20 shown in FIG. 20 and a front portion 30 shown in FIG. 21. The lock can be opened (unlocked) by setting dials 50 of combination mechanism 1000 to an opening combination, as well as by a key 190 associated with a key mechanism 59. The combination mechanism is controlled by dials 50. When all dials 50 are turned to the preset lock-opened combination (opening combination), the opening-gaps 112 of clutches 110 align with the extended protrusion 91 of the spindle 90 which allow the overall clutch 110 (all of the clutches 110) to move leftward relative to housing 20' as viewed from the front (as shown in FIG. 1A). As the user pulls the shackle 40 upward, the lower-slope 122 of clutch-end 120 is pushed by the lower-slope 131 of the pole 130. Surface 125 of the clutch-end 120 is then in contact with wall 115 of clutch 110. As the clutch-end 120 is being pushed leftward by the pole 130, overall clutch 110 is also able to move leftward; since all dials are in the opening combination (lock open code). Pole 130 can then move upward away from housing 20' and since the shackle 40 is assembled within the pole 130; the shackle 40 will move upward together with the pole and short leg 41 of the shackle 40 releasing out of the locking hole 21 of the lock body 20.

Figure 2:
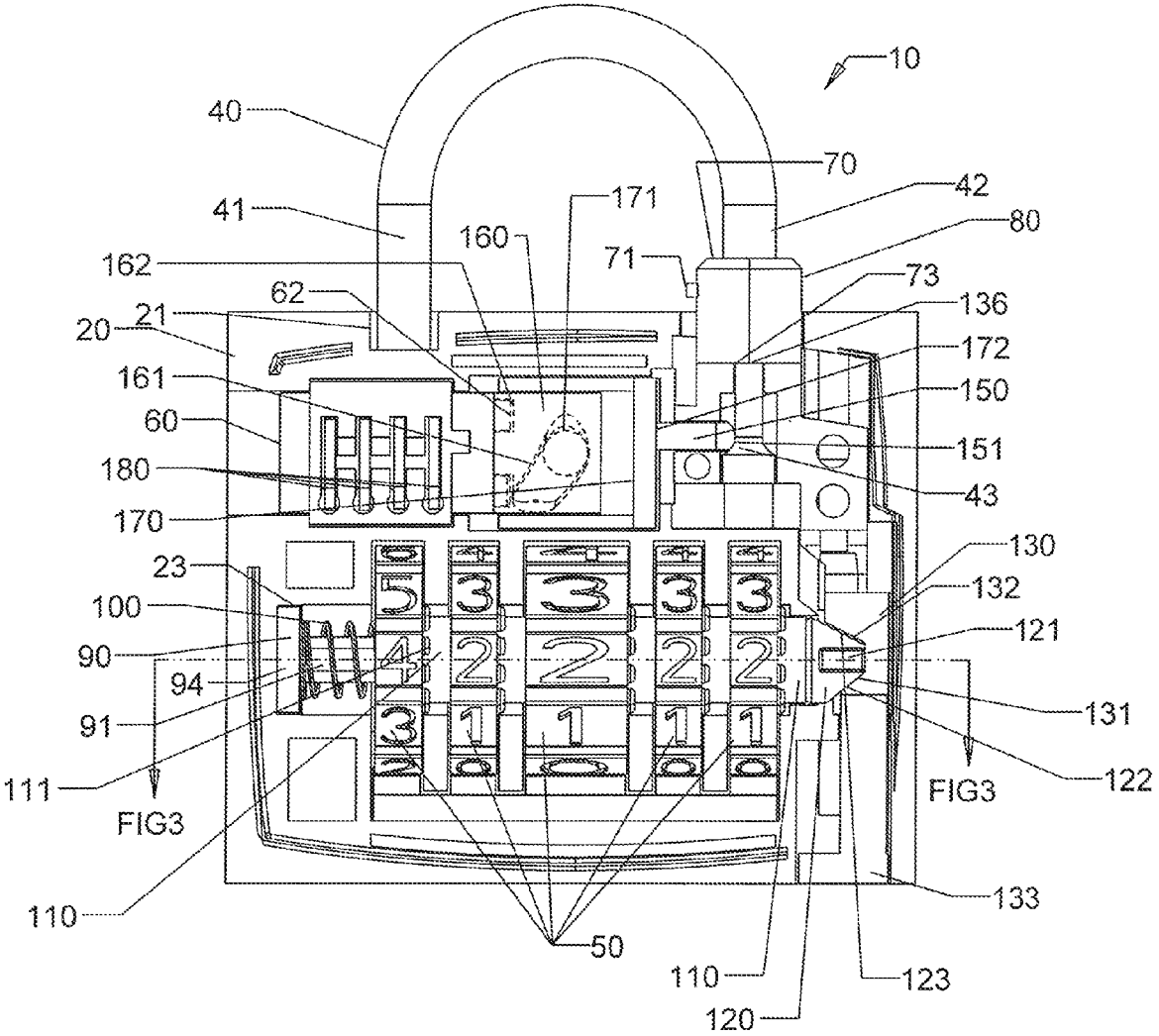
FIG. 2 is a front view of the padlock shown in FIGS. 1A and 1B with a front portion of the lock body/housing removed.

The shackle 40 is sandwiched in the following position: the long-leg 42 of shackle is placed in the slot 134 of the pole 130. The long leg terminates in a heel 45. The short let terminates in a toe 47. The pole 130 is riveted with the pole-cover 140. In one embodiment of the padlock, inside of the pole 130, a sloped section (groove) 43 of the shackle 40 is assembled with a shackle contacting member 150, such as a bolt 150. The bolt has a curved surface 151 that contacts sloped section 43 of the shackle 40. The only way to disengage the bolt 150 from the shackle is to unlock by the key mechanism 59 which will be explained in more detail below. On top of the pole 130, the shackle 40 is also assembled with a ring formed from two pieces 70 and 80. Ring piece 70 has a slot 72 to receive the extended-finger 44 of the shackle 40. The ring pieces 70 and 80 are riveted together with the shackle 40 placed thereon as shown in FIG. 2. Thus, any movement of the shackle 40 is directly transferred to the assembled ring pieces 70 and 80. The ring has a function of controlling the shackle reset function.

After riveting the pole 130, pole-cover 140, shackle 40, with the bolt therein, the pole is controlled by the combination mechanism 1000. The bolt is independently controlled by the key mechanism 59. Both mechanisms independently control the movement of the shackle from a locked position to an unlocked position while the two mechanisms do not interfere with each other.

The key mechanism 59 is controlled by a tumbler 60. When a correct key 190 is entered, the tumbler 60 turns and a cam 160 of the key mechanism also then turns in the same manner. The tumbler and cam move in the same manner because the tumbler 60 has two extended protrusions 62 which always engage into the hole 162 of the cam 160. As the cam 160 turns, the slope-slot 161 of the cam 160 moves which drags a blocking-plate 170 leftward because the blocking-plate 170 has an extended-pin 171 which is always in contact with the slope-slot 161 of the cam 160. The extended-pin 171 always follows the path of the slop-slot 161 of the cam 160. This means that as cam 160 turns the slope-slot 161 drags the extended-pin 171 of blocking-plate 170 leftward and thus a blocking surface 172 of blocking plate 170 also moves to the left. As the blocking surface 172 of the blocking plate 170 moves leftward, the shackle contacting member, such as bolt 150, is able to move leftward. An inspector can then pull the shackle 40 upward, and then the sloped surface 43 of the shackle 40 pushes the curve 151 of the bolt 150 leftward, and wall 152 of bolt 150 is able to move left to release the shackle 40. It should be noticed that the pole 130 does not move in any vertical direction (relative to the housing) during the entire key-operate process. The shackle 40 moves upward away from housing 20' until the sloped surface 43 hits an edge 135 of the pole 130.

Figure 24:
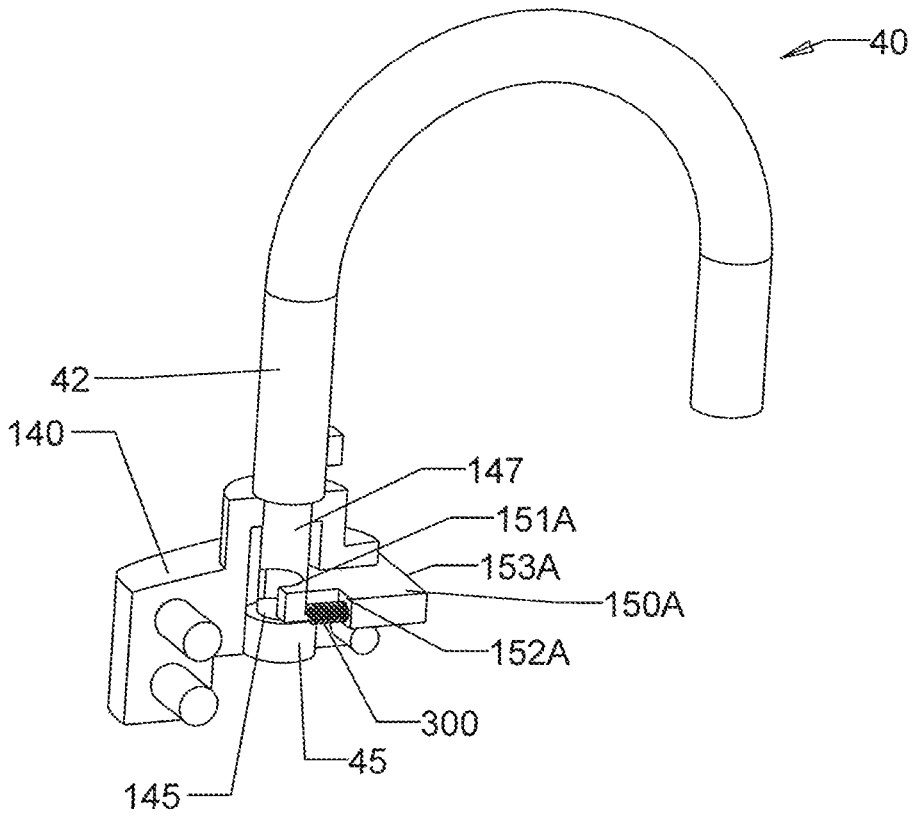
FIG. 24 is a perspective view of an alternative embodiment of shackle 40, as well as an alternative embodiment of a portion of the key mechanism for locking/unlocking the padlock in which a latch is employed instead of a bolt for locking/unlocking the shackle.
Figure 25:
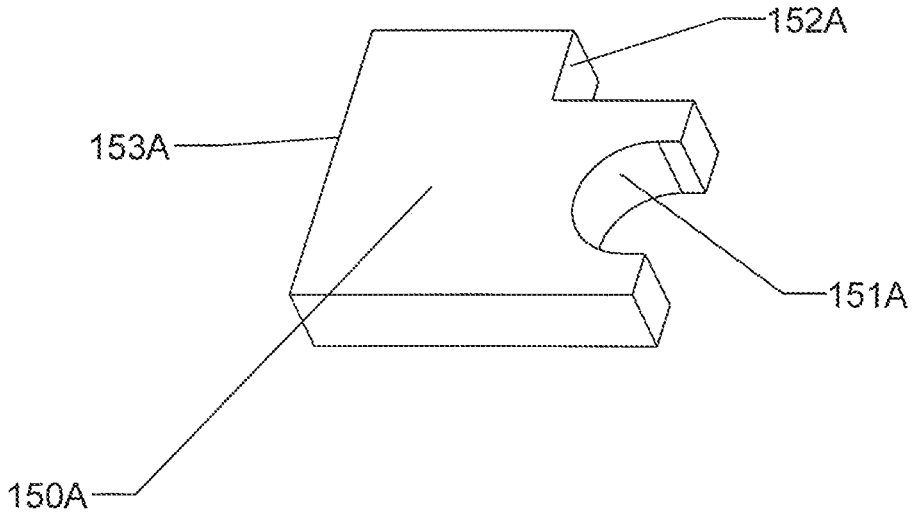
FIG. 25 is an enlarged perspective view of the latch shown in FIG. 24.

In another embodiment of the padlock as seen in FIGS. 24 and 25, a latch 150A with a forked area 151A makes contact with a section 145 of shackle 40 for locking or releasing (unlocking) the shackle relative to the pole and the housing.

An advantage of this key mechanism is to allow a traveler to use the combination mechanism during their trip and allow a TSA officer to inspect luggage by using the key mechanism.

Locked Mode (FIG. 1A-3 and FIG. 10-23):

As shown in FIG. 1A-3 and FIG. 10, the shackle 40 is assembled to the pole 130, pole-cover 140, and the bolt 150 and the dials 50 of combination mechanism are not in an opening combination (for example, 2-2-2-2-2); but rather in locked code (for example, 4-2-2-2-2). This means at least one opening-gap 112 of the clutch 110 is not aligned with the extended protrusion 91 of the spindle 90. This means that the clutches 110 are not able to move leftward. This also means that no matter how much upward pulling force is applied to the shackle, the pole 130 is not able to move upward. This is because the lower-slope 131 of the pole 130 hits the lower-slope 122 of the clutch-end 120. The surface 125 of clutch-end 120 contacts the wall 115 of the overall clutch 110 to move leftward; however, as at least one opening-gap 112 is not aligned with the extended protrusion 91, then it will not allow the clutch-end 120 to push leftward; hence, the lower-slope 131 of the pole 130 remains in contact with the lower-slope 122 of the clutch-end 120, which prevents the shackle 40 from moving upward for releasing.

The shackle 40 is sandwiched in the following position: the long-leg 42 of shackle is placed in the slot 134 of the pole 130. The pole 130 is riveted with the pole-cover 140. Inside of the pole 130, the sloped surface 43 of the shackle 40 is assembled with a bolt 150. Curved surface 151 of the bolt contacts sloped surface 43 of the shackle 40. The only way to disengage the bolt 150 is to unlock the padlock by the key mechanism which is explained more fully below. On top of the pole 130, the shackle 40 is also assembled with a ring pieces 70 and 80. Ring piece 70 has a slot 72 to receive the extended-finger 44 of the shackle 40. The ring pieces 70 and 80 are riveted with the shackle 40 in this position. This means that any movement from the shackle 40 is directly transferred to such assembled ring pieces 70 and 80. The ring thus functions in a manner to control the shackle reset function as discussed below.

Figure 3:
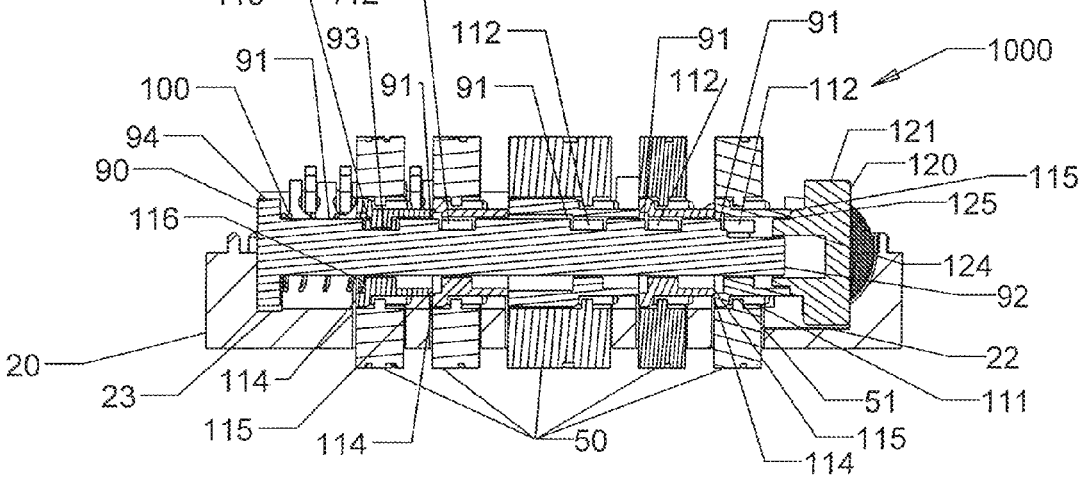
FIG. 3 is a cross-sectional view of the padlock taken along line 3-3 of FIG. 2.

FIG. 3 shows that the spindle 90 has a square block 94 which is placed in a slot 23 of the housing 20', and this placement restricts the spindle 90 from having any movement (spindle has no rotational, vertical, and/or horizontal movement relative to the housing). A spring 100 is inserted between the square block 94 of the spindle 90 and the inner surface 116 of the overall clutch 110. This spring 100 always pushes the clutches 110, and the wall 115 of the overall clutch 110 contacts the surface 125 of the clutch-end 120, which makes the clutch-end 120 engage with lower and upper slopes 131 and 132 of pole 130. The spindle 90 has a flat-end 92 which is placed inside of a hole 124 formed in clutch-end 120. The clutch-end 120 has a wing 121 which is placed inside wing-slot 22 of the rear portion 20 of housing 20'. This prevents the clutch-end 120 from rotating and only allows the clutch-end to have horizontal movement (moving left or right) relative to the housing. In addition, the first (leftmost as viewed in FIG. 3) clutch 110 has faulty notches 113 which prevents any intruder from easily picking the real opening-gap 112 of the clutch 110 to open the padlock 10.

In the locked state, the key 190 is not present and the wafers plate 180 is still extended outward which prevents the cylinder 60 from turning. As the cam 160 is not turning, the slope-slot 161 of the cam 160 does not move and the extended-pin 171 of the blocking-plate 170 is not able to move. As the blocking plate 170 is not moving, the blocking surface 172 cannot move, and the wall 152 of the bolt 150 is not able to move leftward, hence the curved surface 151 of bolt 150 is engaged with the sloped surface 43 of the shackle 40. The shackle 40 is securely locked inside of the locking hole 21 of the lock body rear portion 20.

Unlock by Combination Mechanism (FIG. 4-5):

A combination mechanism 1000 includes dials 50 and clutches 110. The dials 50 have teeth 51 that receive extended fins 111 of the clutches 110. The overall clutch refers to all of the individual clutches 110. The teeth and fins are engaged with each other all the time unless the combination mechanism is in the reset state. When the dials 50 are aligned to the opening combination, the opening gap 112 of the corresponding clutch 110 is aligned with the extended-protrusion 91 of the spindle 90. Since there is nothing to block overall clutch 110, the user can pull the shackle 40 upward and since the shackle 40 is assembled with the pole 130, then the pole is also pulled upward. The shackle sloped surface 43 is engaged with the curved surface 151 of bolt 150. Also, the bolt 150 is placed in the bolt-receiving-slot 137 of the pole 130. As the shackle, pole, and the pole-cover are riveted together, then pulling of the shackle transfers to the bolt 150, and the bolt is in the bolt-receiving-slot 137. This arrangement transfers the pulling to the lower slope 131 of the pole 130 (see FIG. 12).

As the pole 130 is being to pulled upward, the lower slope 131 of the pole 130 contacts the lower slope 122 of the clutch-end 120. The clutch-end 120 then moves leftward, and the surface 125 of the clutch-end 120 pushes the wall 115 of clutch 110 leftward which contacts the top-flat-surface 114 of next clutch 110. With this reaction, the overall clutch 110 moves leftward to a lock open position, which allows pole 130 to be pulled upward as the shackle is pulsed upward (away) from housing 20.

The clutch-end 120 has two different angles of slopes, the lower slope 122 is for the opening combination, and the upper slope 123 is for the reset state. The lower slope 122 has an angle which allows for pushing the overall clutch 110 leftward, but to keep the extended-fin 111 of the clutches engaged with the teeth 51 of the dial 50. Hence, in the opening combination, the extended fins 111 of the clutches 110 move leftward; but the extended fins 111 remain engaged with the teeth 51 of the dial 50. Also, the opening gaps are is engaged with the extended protrusions 91 of the spindle 90 which prevents the overall clutch 110 from having rotational movement and also restricts the dials 50 from turning. This is an advantage since when in the opening combination state, the user is not allowed to rotate dials which avoids problems (accidentally changing the opening combination) when the shackle is pushed back to the lock position.

In this state, the bolt 150 moves upward, because it is assembled with the shackle 40 and the pole 130, and the pole cover 140. The curved surface 151 of bolt 150 is still engaged with the sloped surface 43 of the shackle; therefore, as the pole 130 and shackle 40 is pulled upward, the bolt 150 moves upward in a similar manner.

Reset State (FIG. 6-7):

When the dials 50 are aligned in the opening combination, the opening gaps 112 of the clutches 110 align with extended-protrusion 91 of the spindle 90.

Since extended-finger 44 of the shackle 40 is assembled with the slot 72 in ring 70, any movement of the shackle will act in a similar manner on ring pieces 70 and 80.

Figure 6:
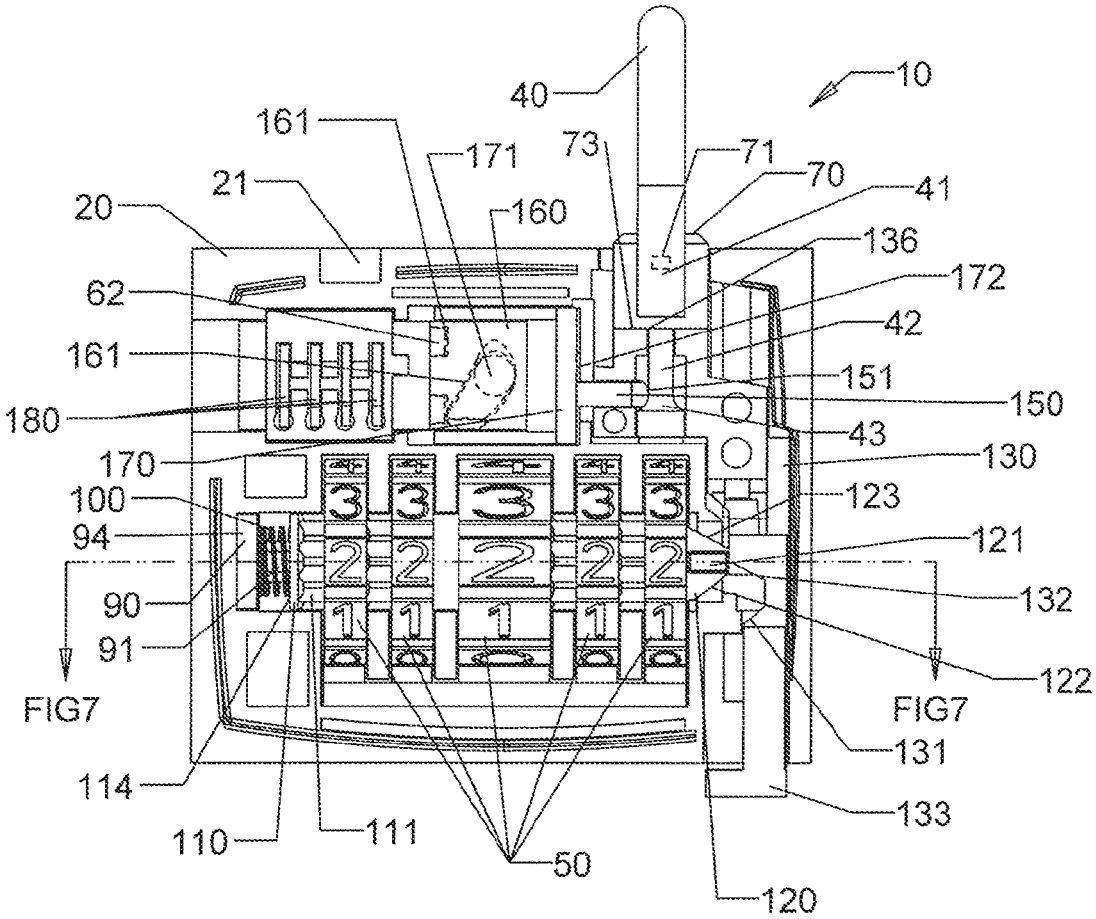
FIG. 6 is a front view of the padlock with the front portion of the lock body/housing removed and with the shackle pushed toward the housing to allow the opening combination to be reset.
Figure 7:
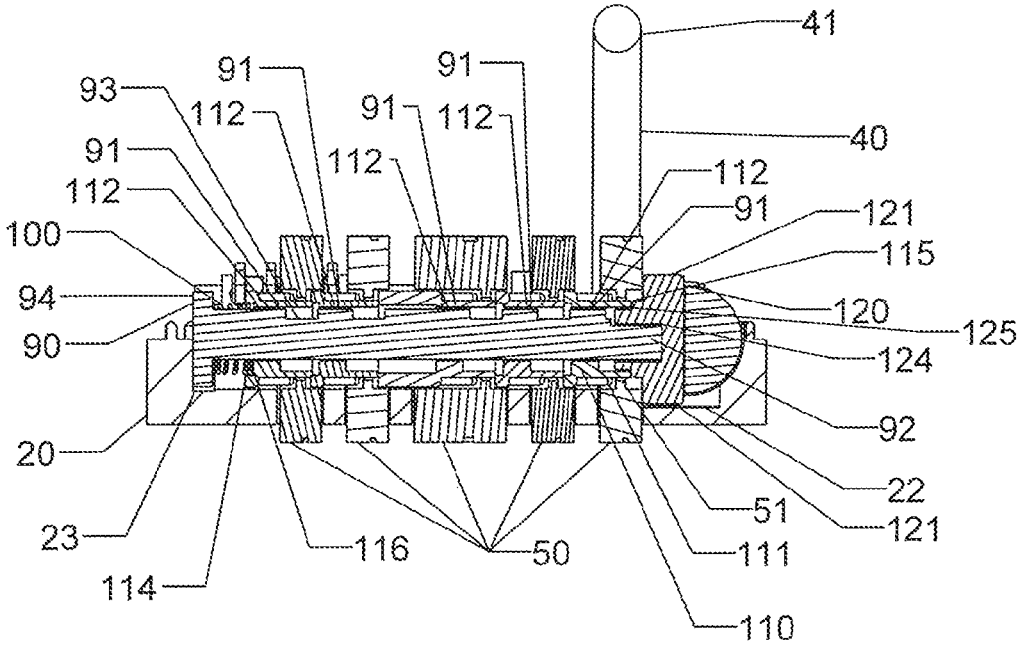
FIG. 7 is a cross-sectional view taken along line 7-7 of FIG. 6.

The user can pull the shackle 40 upward to release the short leg 41 out of the housing 20'. Then, the user can rotate the shackle conterclockwise such that the extended-projection 71 of the ring 70 aligns with a reset slot 33 of the lock body 20 (see FIGS. 1A and 6). With this setup, the shackle 40 can be pushed downward so as to enter the reset state (FIG. 6).

As the shackle 40 is being pushed downward (continuously), the bottom-surface 73 of the ring contacts the upper-surface 136 of pole 130. As the pole 130 is being pushed downward, the upper-slope 132 of the pole 130 contacts the upper slope 123 of the clutch-end 120. As mentioned above with respect to the combination mechanism, as one slope contacts the other, the surface 125 of the clutch-end 120 pushes the wall 115 of the clutch 110 leftward; and hence, the overall clutch moves leftward. Unlike the combination state, this time the upper slope 123 of the clutch-end 120 and the upper slope 132 of the pole 130 push the overall clutch 110 further to the left which causes the extended-fins 111 of the clutches 110 to fully disengage with the teeth 51 of the dials 50. The user can then rotate the dials 50 to a new desired opening combination. In the meanwhile, the opening gaps 112 of the clutches 110 are fully engaged with the extended-protrusions 91 of the spindle 90 which prevents any rotational movement of the clutches 110. Also, when in the reset state, tip 133 of the pole is pushed out of body 20' and is exposed as seen in FIG. 6.

Figure 4:
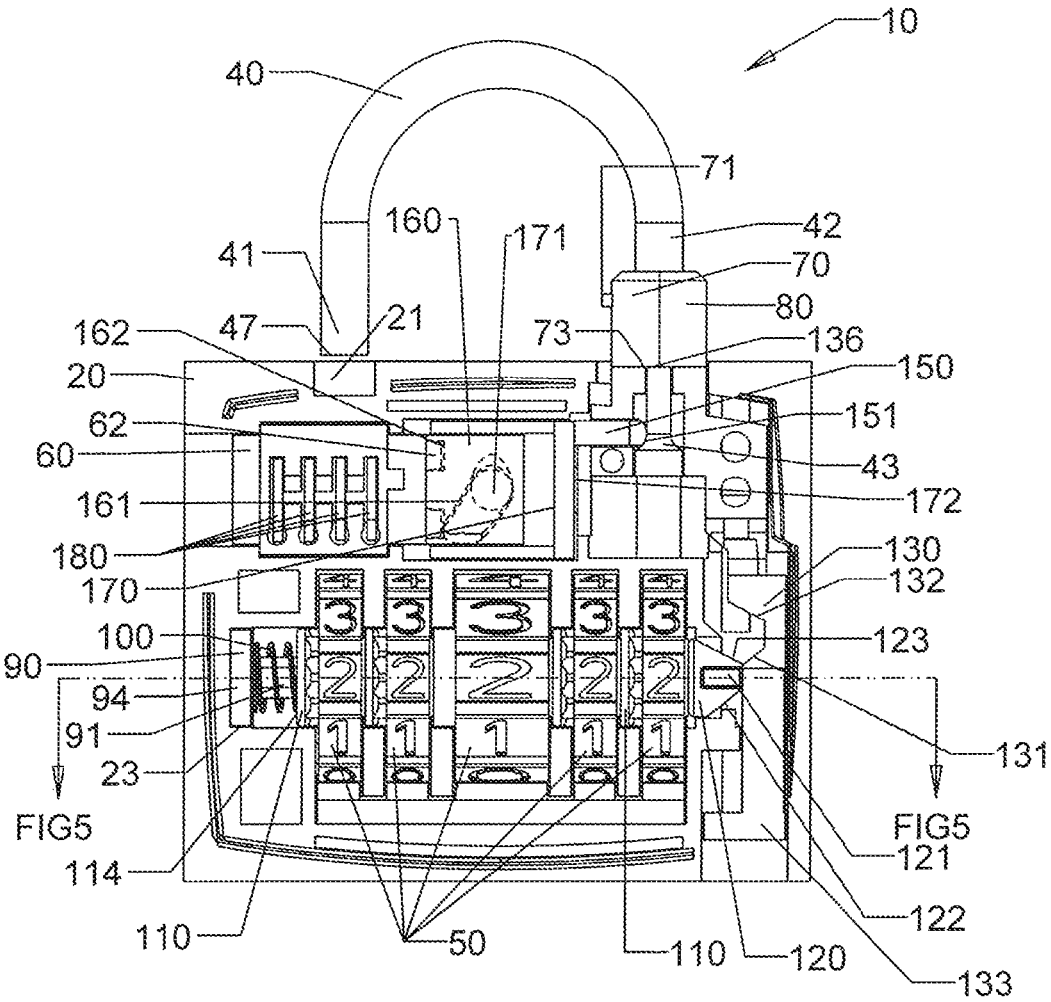
FIG. 4 is a view of the padlock similar to FIG. 2, but showing the shackle in the unlocked/opened state or position.
Figure 5:
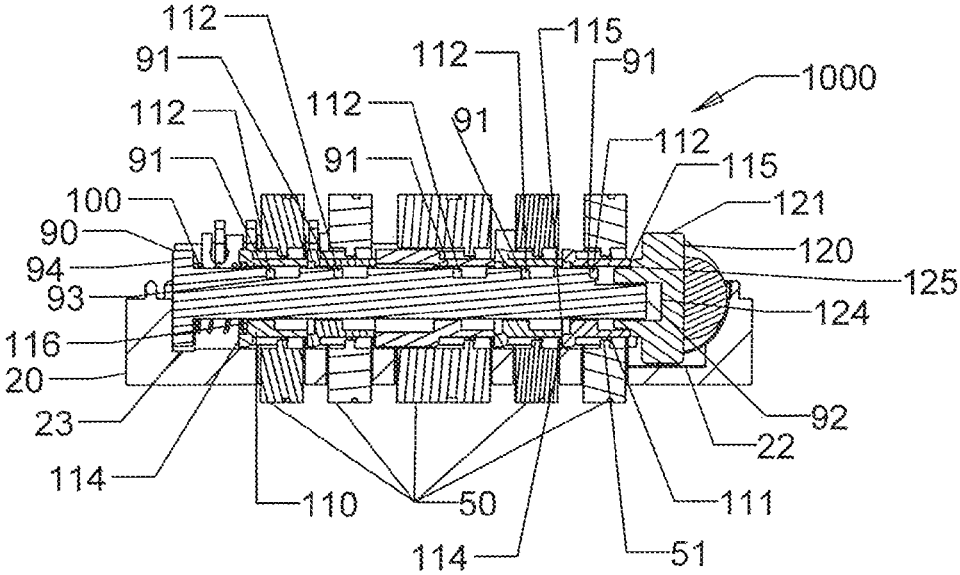
FIG. 5 is a cross-sectional view of the padlock taken along line 5-5 of FIG. 4.
Figure 8:
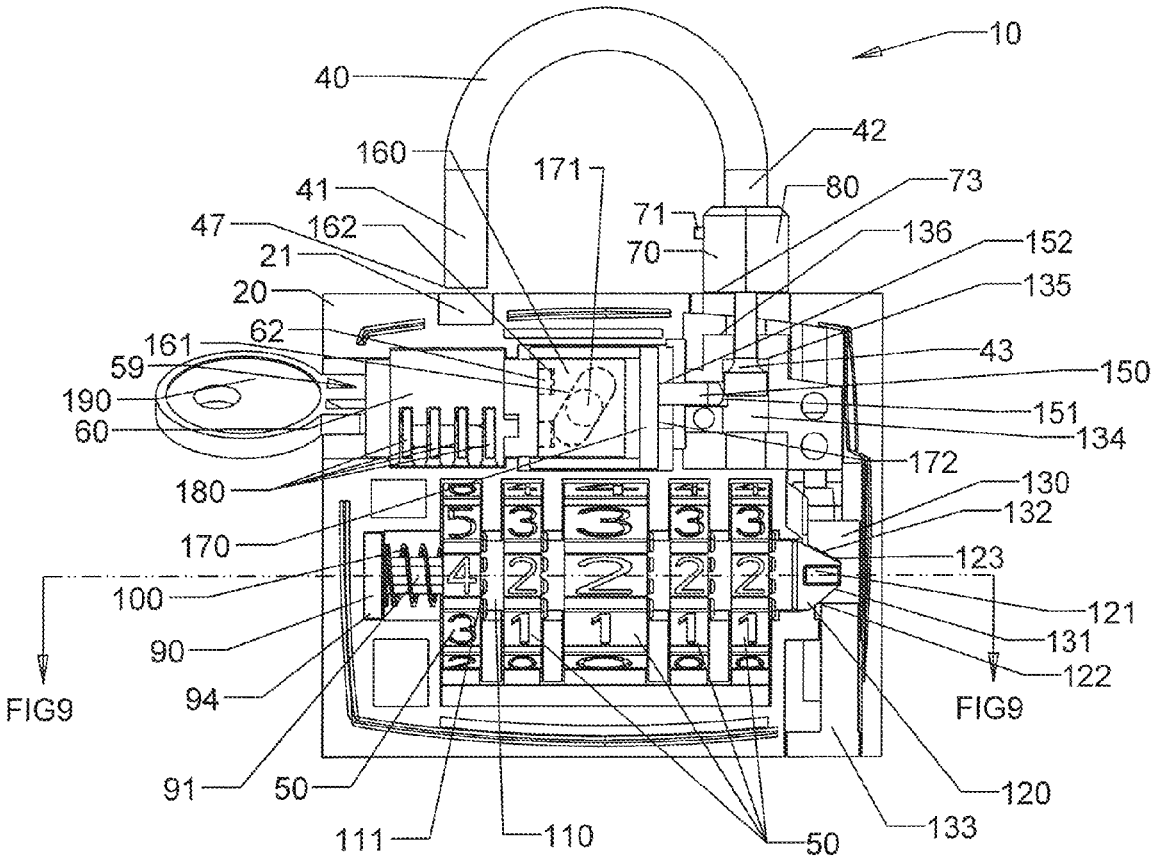
FIG. 8 is a front view of the padlock with the front portion of the lock body/housing removed and with the shackle showing a key inserted into the key mechanism of the padlock.
Figure 9:
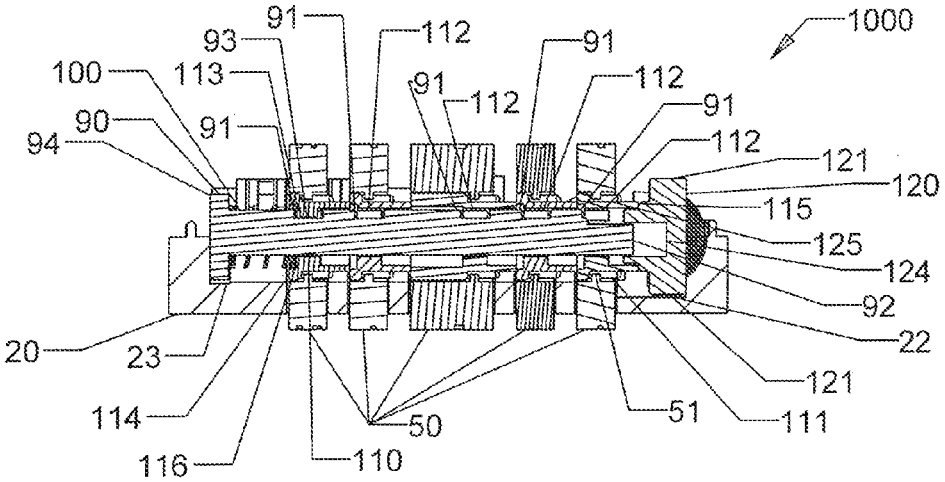
FIG. 9 is a cross-sectional view taken along line 9-9 of FIG. 8.
Figure 10:
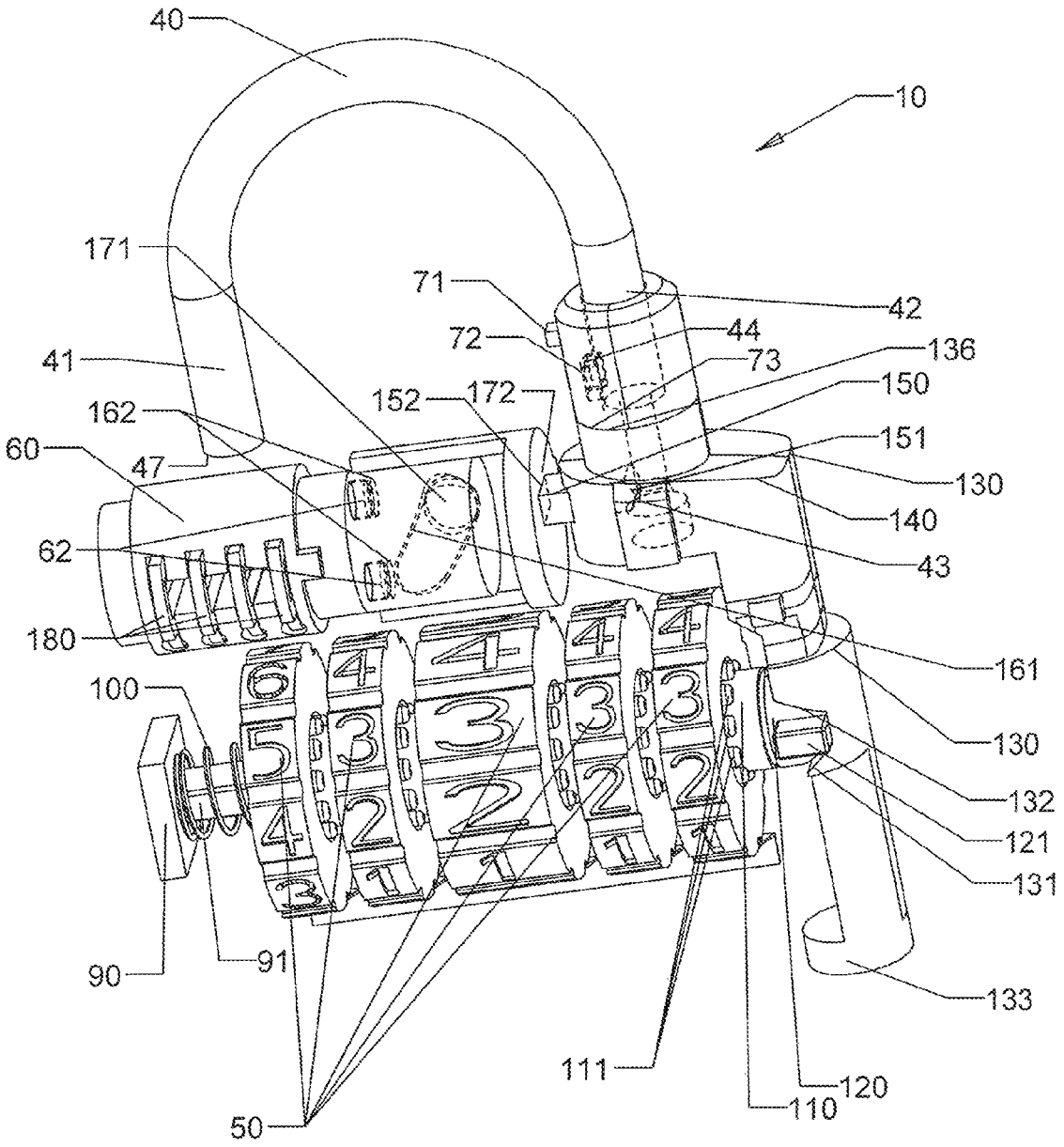
FIG. 10 is an exploded perspective view of a portion of the dials and the cylinder of the padlock.
Figure 11:
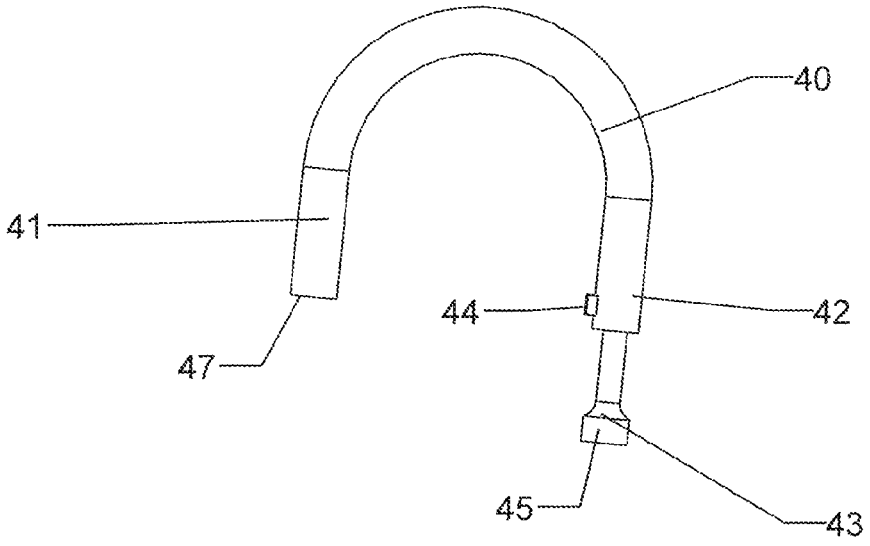
FIG. 11 is a perspective view of the shackle and associated parts thereof of the padlock.
Figure 12:
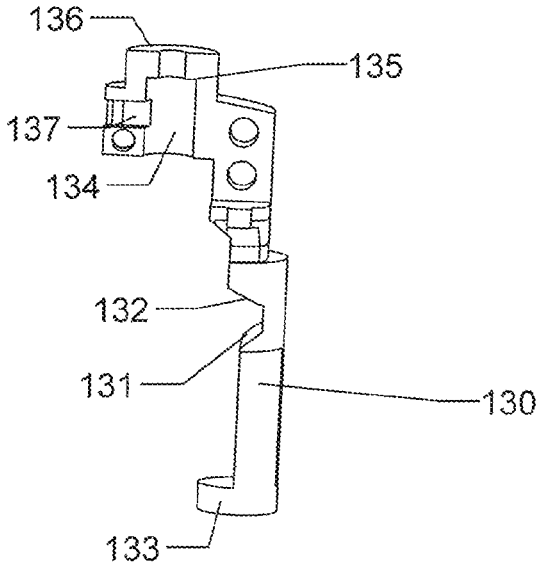
FIG. 12 is a perspective view of a pole forming part of the padlock.
Figure 13:
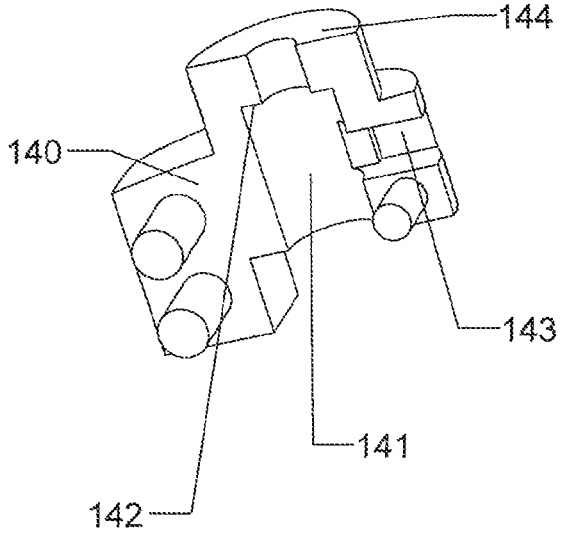
FIG. 13 is a perspective view of a pole cover forming part of the padlock.
Figure 14:
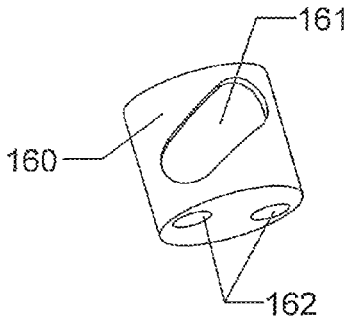
FIG. 14 is a perspective view of a cam and related parts of the padlock.
Figure 15:
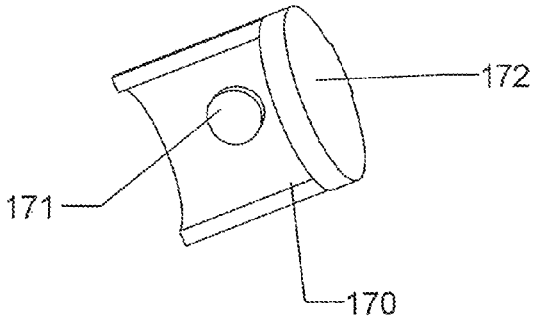
FIG. 15 is a perspective view of a blocking plate and related parts of the padlock.
Figure 16:
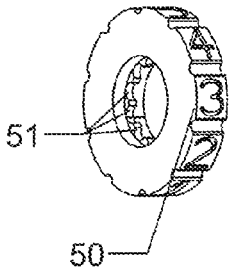
FIG. 16 is a perspective view of one of the dials of the padlock.
Figure 17A:
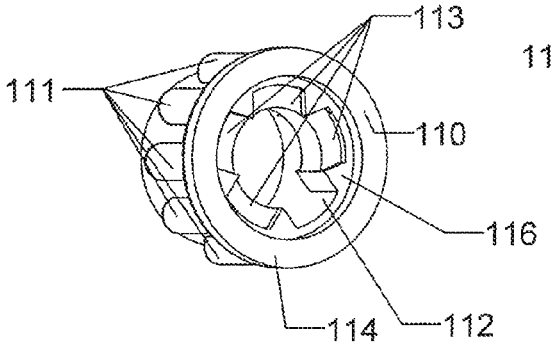
FIG. 17A is a front perspective view of a clutch and related parts of the padlock.
Figure 17B:
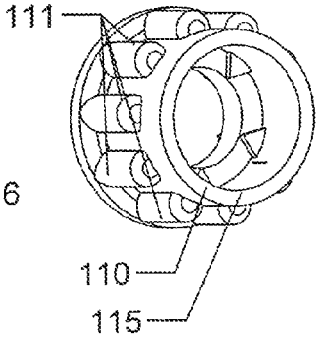
FIG. 17B is a rear perspective view of the clutch shown in FIG. 17A.
Figure 18A:
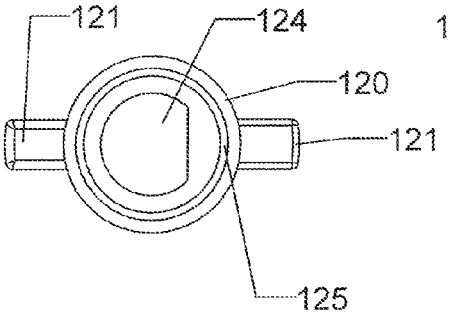
FIG. 18A is a front view of a clutch-end of the padlock.
Figure 18B:
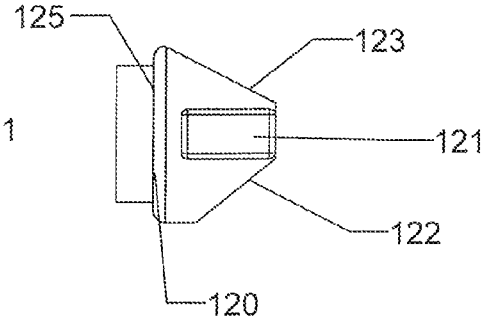
FIG. 18B is a side view of the clutch-end shown in FIG. 18A.
Figure 19:
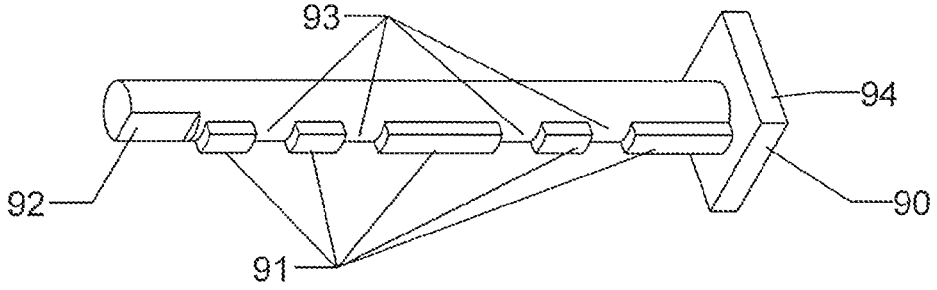
FIG. 19 is a perspective view of a spindle forming part of the combination mechanism of the padlock.

Unlock by Key (FIGS. 4, 8, 10, 24-27):

A first embodiment of the key mechanism is shown in FIGS. 4, 8 and 10, and a second embodiment using a latch instead of a bolt having details of the latch shown in FIGS. 24-27. The remaining portions of the key mechanism are common to both embodiments. The key mechanism is controlled by a tumbler 60. When a correct key 190 enters the tumbler, the tumbler 60 turns and the cam 160 turns in the same manner. They move in the same manner because the cylinder 60 has two extended protrusions 62 which always engage into the hole 162 of the cam 160. As the cam 160 turns, the slope-slot 161 of the cam 160 moves which drags the blocking-plate 170 leftward because the blocking-plate 170 has an extended-pin 171 which is always in contact with the slope-slot 161 of the cam 160. The extended-pin 171 follows the path of the slope-slot 161 of the cam 160. This means that as cam 160 turns the slope-slot 161 drags the extended-pin 171 of blocking-plate 170 leftward and the blocking surface 172 moves to the left. As the blocking surface 172 of the blocking plate 170 moves leftward, the bolt 150 can move leftward. The inspector can then pull the shackle 40 upward, then the sloped surface 43 of the shackle 40 pushes the curved end 151 of the bolt 150 leftward, and the wall 152 of the bolt 150 is able to move leftward which releases the shackle 40. It should be noticed that the pole 130 is not moving in any vertical direction during the entire key-operate process. The shackle 40 will move upward until the groove 43 hits the edge 135 of the pole 130.

As seen in FIGS. 24-27 an alternative embodiment of the key mechanism uses a latch 150A instead of bolt 150 for securing the key mechanism to the shackle. In this alternative embodiment, the latch has a fork 151A that contacts an alternative embodiment of shackle 40 having a flat portion 145 instead of a sloped section 43 (see FIG. 4 showing the first embodiment of shackle 40) where the flat section 145 of long leg 42 is at the terminating end or heel 45 of shackle 40. Thus, the second embodiment of shackle 40 has a portion (shackle neck) 147 of its long leg 42 which is cylindrical in shape (without a slope section) that terminates in a wider cylindrical portion forming the heel 45. Thus, fork 151A of latch 150A is positioned next to this region of the long leg which prevents movement of shackle 40 away from pole cover 140.

Figure 27:
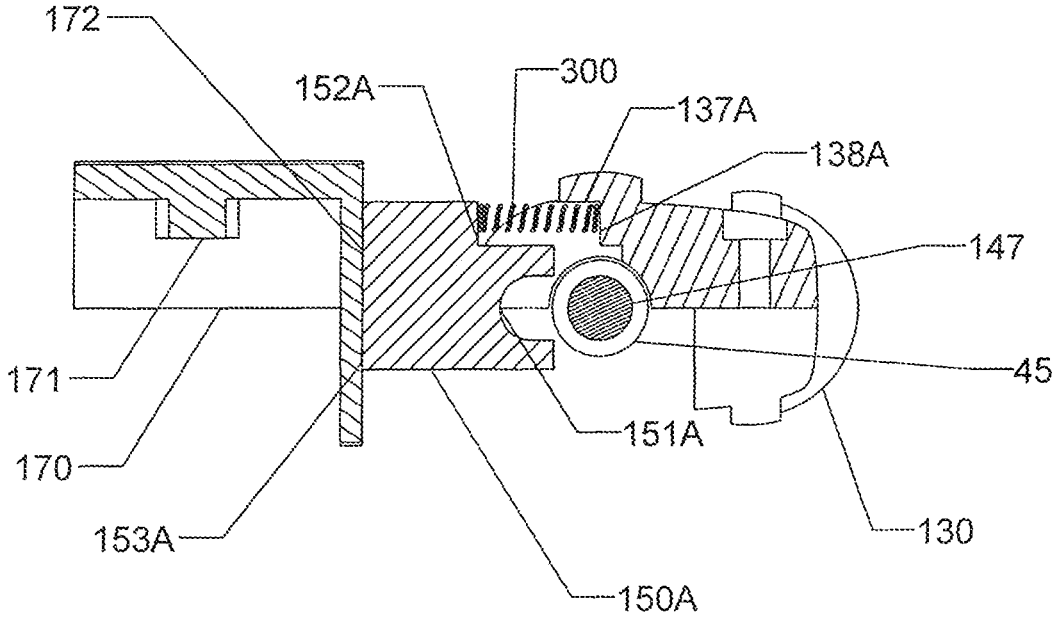
FIG. 27 is an enlarged cross-sectional view of the latch in the unlocked state.

As seen in FIG. 27, when the key mechanism is in the unlocked state, a spring 300 pushes wall 152A which in turn pushes fork 151A away from section 145 of long leg 42. Thus, when the key mechanism is in the unlocked state, the blocking plate 170 will move leftward and thus wall 172 moves and spring 300 in channel 137A thus pushes the latch leftward along with wall 153A of the latch in contact with wall 172 of the blocking plate. Therefore, the latch moves away from the shackle leg 42 and thus fork 151A disengages from shackle section 145, thereby allowing the shackle to be pulled away from housing 20' and away from pole cover 140.

Figure 26:
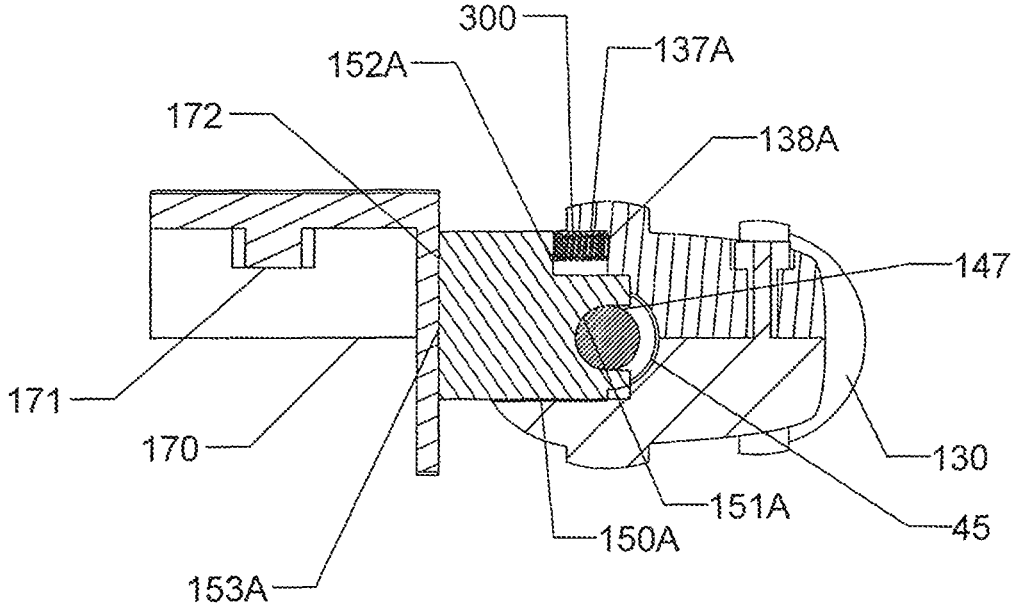
FIG. 26 is an enlarged cross-sectional view of the latch shown in FIGS. 24 and 25 in the locked state along with a blocking plate of the key mechanism.

When the key mechanism is in a locked position as shown in FIG. 26, a blocking plate 170 pushes latch 150A toward section 145 so as to engage fork 151A to the shackle thereby preventing pulling of the shackle 40 away from pole cover 140. More particularly, when the key mechanism is in the locked state, wall 172 of blocking plate 170 contacts wall 153A of the latch so as to compress spring 300 (spring 300 is placed between wall 152A of latch 150A and the wall 138A of pole 130). As noted above, the spring is placed in channel 137A of the pole. Since the blocking plate is not moving leftward, fork 151A is engaged with the shackle neck 147 which prevents the shackle from being pulled away from housing 20'.

Thus, the operation of this alternative embodiment of the key mechanism corresponds to that described above with respect to the first embodiment of the key mechanism except that it uses a latch and associated fork for preventing or allowing movement of the shackle relative to the housing depending upon the key mechanism's locked or unlocked state.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A padlock comprising:

a shackle having a short leg portion, a long leg portion, and a toe at an end of the short leg portion and a heel at an end of the long leg portion;

a housing having holes formed therein dimensioned to receive the toe and the heel of the shackle; the heel of the shackle positioned inside the housing, the shackle movable between an unlocked position with the toe positioned away from the housing and a locked position with the toe located inside the housing;

a pole and a pole cover secured around a portion of the long leg of the shackle, a key mechanism having a locked state and an unlocked state, the key mechanism including a tumbler for receipt of a key, and a shackle contacting member, the shackle contacting member passing through a slot formed in the pole and the pole cover, the shackle contacting member in contact with the shackle so as to prevent movement of the shackle relative to the key mechanism when the key mechanism is in the locked state, the shackle contacting member configured to move in the housing relative to the shackle so as to allow the shackle to move relative to both the housing and the pole so as to release the toe from the housing when the key mechanism is in the unlocked state; and a combination mechanism connected to the pole, the combination mechanism having a clutch-end engaged with slopes formed in the pole when the combination mechanism is in a locked state, the combination mechanism including a plurality of dials with teeth, a spindle placed in proximity to the dials and an overall clutch comprising a plurality of clutches such that when the dials are in an opening combination, extended protrusions of the spindle align with opening gaps of the clutches, allowing the clutches to move relative to the housing into a lock open position and allowing the pole and the pole cover to move relative to the housing so as to release the toe of the shackle from the housing when the shackle is pulled away from the housing, wherein the clutches comprise extended-fins movably engaged with the teeth of the dials and wherein the clutch-end has a lower slope and an upper slope movably engaged with the slopes formed in the pole, the lower slope configured to control movement of the pole in a first direction so as to release the toe of the shackle from the housing while the extended-fins of the clutches remain engaged with the teeth of the dials and the opening gaps of the clutches are engaged with the extended protrusions of the spindle so as to prevent the clutches from having rotational movement and thereby restricts rotation and movement of the dials, and the upper slope configured to control a reset state of the combination mechanism when the toe of the shackle has been released from the housing such that as the pole is caused to move in a second direction opposite to the first direction, the pole pushes the clutch-end, causing the clutches to move further relative to the housing in a third direction different from the first and second directions such that the extended-fins of the clutches disengage with the teeth of the dials, allowing the opening combination of the combination mechanism to be reset.

2. The padlock according to claim 1, wherein the third direction is substantially perpendicular to the first direction, and wherein the slopes formed in the pole have a first slope movably engaged with the lower slope of the clutch-end and a second slope movably engaged with the upper slope of the clutch-end, such that when the pole is caused to move in a movement in the first direction, the movement of the pole in the first direction and contact of the first slope of the pole with the lower slope of the clutch-end cause the clutches to move a first distance in the third direction, and when the pole is caused to move in a movement in the second direction, the movement of the pole in the second direction and contact of the second slope of the pole with the upper slope of the clutch-end cause the clutches to move a second distance in the third direction, the second distance greater than the first distance.

3. The padlock according to claim 2, wherein a ring is positioned around a portion of the shackle, wherein the shackle includes an extended-projection that passes through the ring, wherein when the toe of the shackle is released from the housing, the shackle is rotatable relative to the housing to allow the extended-projection to be inserted into a reset slot formed in the housing, thereby allowing the pole to be moved in the second direction by pushing the shackle toward the housing so as to cause the combination mechanism to be moved to the reset state that allows the dials to be turned to reset the opening combination.

4. The padlock according to claim 3, wherein the spindle includes a block placed in a slot formed in the combination mechanism so as to prevent movement of the spindle, wherein when the dials are in the opening combination, the extended protrusion of the spindle is aligned with an opening slot of the overall clutch and the overall clutch is allowed to move relative to the housing when the pole is moved relative to the housing by pulling the shackle away from the housing.

5. The padlock according to claim 1, wherein the spindle includes a block placed in a slot formed in the combination mechanism so as to prevent movement of the spindle, wherein when the dials are in the opening combination, the extended protrusion of the spindle is aligned with an opening slot of the overall clutch and the overall clutch is allowed to move relative to the housing when the pole is moved relative to the housing by pulling the shackle away from the housing.

6. The padlock according to claim 1, wherein the key mechanism includes a cylinder, a blocking plate and a cam, the blocking plate in contact with the shackle contacting member, the blocking plate with an extended ring engaged with a slope-slot formed in the cam, wherein the cam is connected to the cylinder by an extended protrusion of the cylinder, wherein movement of the cam allows the blocking plate to move relative to the housing and thereby allows the shackle contacting member to move away from the shackle to unlock the shackle when the key mechanism is in the unlocked state.

7. The padlock according to claim 5, wherein the shackle contacting member remains in contact with the shackle when the dials are in the opening combination and when the combination mechanism is in the reset state, and wherein the shackle contacting member is allowed to move relative to the housing when the key mechanism is in the unlocked state.

8. The padlock according to claim 1, wherein the shackle contacting member is a bolt, wherein the shackle includes a sloped section formed on the long leg of the shackle, wherein the bolt is in contact with the sloped section of the shackle when the key mechanism is in the locked state and wherein the bolt is able to move in the housing relative to the sloped section to allow the shackle to move relative to the housing and the pole so as to release the toe from the housing when the key mechanism is in the unlocked state.

9. The padlock according to claim 8, wherein the bolt remains in the sloped section of the shackle when the dials are in the opening combination and when the combination mechanism is in the reset state, and wherein the bolt is allowed to move relative to the housing when the key mechanism is in the unlocked state.

10. The padlock according to claim 8, wherein the bolt, shackle, pole, and pole cover are assembled together to form one piece, wherein the bolt engages with the sloped section of the shackle so that pulling the shackle relative to the housing is transferred to the pole.

11. The padlock according to claim 8, wherein the sloped section of the shackle is placed inside the pole and the pole cover, wherein the sloped section engages the bolt when the key mechanism is in the locked state, or when the dials are in the opening combination, or when the combination mechanism is in the reset state; and wherein the bolt disengages from the sloped section of the shackle when the key mechanism is in the unlocked state.

12. The padlock according to claim 8, wherein when the dials of the combination mechanism are in the opening combination, the bolt has no movement relative to the sloped section of the shackle.

13. The padlock according to claim 8, wherein the third direction is substantially perpendicular to the first direction, and wherein the slopes formed in the pole have a first slope movably engaged with the lower slope of the clutch-end and a second slope movably engaged with the upper slope of the clutch-end, such that when the pole is caused to move in a movement in the first direction, the movement of the pole in the first direction and contact of the first slope of the pole with the lower slope of the clutch-end cause the clutches to move a first distance in the third direction, and when the pole is caused to move in a movement in the second direction, the movement of the pole in the second direction and contact of the second slope of the pole with the upper slope of the clutch-end cause the clutches to move a second distance in the third direction, the second distance greater than the first distance.

14. The padlock according to claim 13, wherein a ring is positioned around a portion of the shackle, wherein the shackle includes an extended-projection that passes through the ring, wherein when the toe of the shackle is released from the housing, the shackle is rotatable relative to the housing to allow the extended-projection to be inserted into a reset slot formed in the housing thereby allowing the pole to be moved by pushing the shackle toward the housing so as to cause the combination mechanism to be moved to the reset state that allows the dials to be turned to reset the opening combination.

15. The padlock according to claim 1, wherein when the dials of the combination mechanism are in the opening combination, the shackle contacting member has no movement relative to the shackle.

16. The padlock according to claim 1, wherein the shackle contacting member is a latch having a fork, wherein the shackle long leg includes a shackle section dimensioned to contact the fork of the latch when the key mechanism is in the locked state and wherein the fork of the latch is moved away from said shackle section when the key mechanism is in the unlocked state.

17. The padlock according to claim 16, wherein the latch includes a spring to push a blocking plate of the key mechanism when the key mechanism is in the unlocked state and wherein the blocking plate pushes the latch to cause the fork of the latch toward the shackle when the key mechanism is in the locked state.

18. The padlock according to claim 16, wherein a ring is positioned around a portion of the shackle, wherein the shackle includes an extended-projection that passes through the ring, wherein when the toe of the shackle is released from the housing, the shackle is rotatable relative to the housing to allow the extended-projection to be inserted into a reset slot formed in the housing thereby allowing the pole to be moved by pushing the shackle toward the housing so as to cause the combination mechanism to be moved to the reset state that allows the dials to be turned to reset the opening combination.

* * * * *